United States Patent [19]

Bible

[11] Patent Number: 4,741,051

[45] Date of Patent: May 3, 1988

[54] PROTECTIVE MITT FOR USE WITH HANDCUFFS

[76] Inventor: Kenneth G. Bible, 201 Butler Dr., Greenville, S.C. 29611

[21] Appl. No.: 23,149

[22] Filed: Mar. 9, 1987

[51] Int. Cl.[4] ..... A41D 13/08

[52] U.S. Cl. ..... 2/158; 2/16; 2/66; 70/16

[58] Field of Search ..... 2/158, 159, 160, 162, 2/16, 17, 66; 70/16; 150/118

[56] References Cited

U.S. PATENT DOCUMENTS

| | | | |
|---|---|---|---|
| 404,544 | 6/1889 | James et al. | 70/16 |
| 1,529,546 | 3/1925 | McKenzie | 70/16 |
| 2,727,241 | 12/1955 | Smith | 2/66 |
| 2,835,896 | 5/1958 | Giese | 2/66 |
| 3,203,005 | 8/1965 | Burrows | 2/158 |
| 3,253,589 | 5/1966 | Shook | 2/16 X |
| 3,491,373 | 1/1970 | Thomas | 2/158 X |

*Primary Examiner*—Louis K. Rimrodt
*Assistant Examiner*—Judith L. Olds
*Attorney, Agent, or Firm*—Bailey & Hardaway

[57] ABSTRACT

The drawing illustrates a protective mitt for use by police officers and the like when placing handcuffs on the wrists of prisoners behind the back wherein a connection extends between both hands for further restraining movement of the hands and providing a covering therefor wherein opposed fabric wall panels form a pouch having an open top with tie means securing the cuffs within the pouch and separating the hands within the pouch.

6 Claims, 1 Drawing Sheet

PROTECTIVE MITT FOR USE WITH HANDCUFFS

BACKGROUND OF THE INVENTION

This invention relates to protective devices useful by police officers and the like when handcuffing prisoners or others wherein similar restraints are imposed. U.S. Pat. No. 404,544 discloses handcuffs and separate mittens integral with the respective cuffs associated with each hand. U.S. Pat. Nos. 91,382, 1,529,546, 2,557,280, 2,725,564, 3,354,922 and 4,426,739 are directed generally to other receptacles within which a person's hands may be placed.

The above structures have the disadvantage of being relatively complex requiring the expenditure of substantial labor in the manufacture thereof. Moreover, such do not provide a protective device for covering the hands of the wearer with central means for separating the hands, thus restricting further movement while covering the hands against use thereof to retrieve a gun or other objects. Preferably the mitt is constructed of a non-woven fabric which is bulky but which provides air flow therethrough. Thus, there is no discomfort to the prisoner's hands, and the fabric enables officers to collect and protect evidence on the prisoner's hands. The protective mitt is separate from the handcuffs so as not to interfere with the initial placement of the handcuffs.

SUMMARY OF THE INVENTION

It has been found that a protective mitt may be provided by utilizing a pair of opposed fabric wall panels connected thereabout by providing an open top for insertion of the hands and handcuffs into the pouch formed by the panels with the provision of tie means extending between the respective cuffs securing the cuffs within the pouch while separating and restricting movement of the hands.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
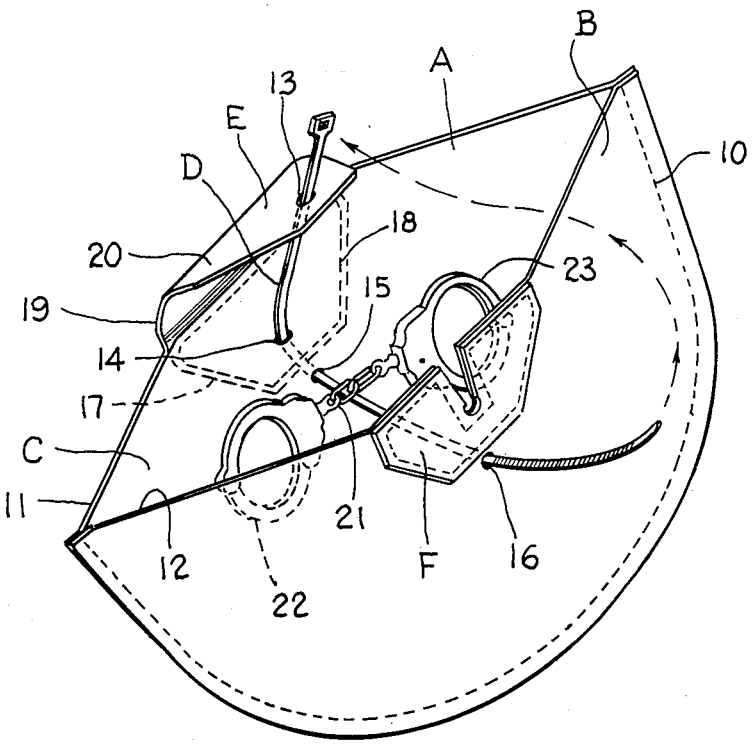
FIG. 1 is a perspective view illustrating a cuff mitt open at the top showing the placement of handcuffs within the mitt preparatory to securing same, constructed in accordance with the invention.
Figure 2:
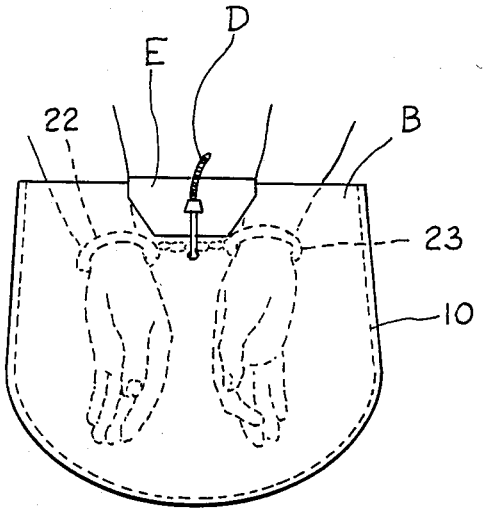
FIG. 2 is a front elevation illustrating the mitt secured about the hands of the wearer with securement of the handcuffs with separation of the hands when placed behind the back.

The drawing illustrates a protective mitt for use by police officers and other attendants when placing handcuffs on the wrists behind the back having a connection extending between the hands for further restraining movement of the hands and providing a cover therefor. A pair of opposed fabric wall panels A and B are secured about edge portions leaving an open top C for insertion of the hands and wrists with the handcuff carried thereon. The fabric wall panels form a pouch containing the hands, wrists and the handcuffs.

Tie means D are carried by the pouch extending between respective cuffs securing the cuffs within the pouch. Thus, the hands are covered and movement thereof is restricted. The fabric wall panels may be constructed of bulky non-woven material. A stiff flap E is carried on one of the fabric wall panels which then passes over an opposite fabric wall panel between said respective cuffs receiving the tie means. A tab F is carried by the opposite fabric wall panel over which the flap is positioned for retention by the tie means. Preferably the tie means is a lock strap.

The wall panels A and B are illustrated as being secured thereabout by stitching 10 which is illustrated as being in a substantially U-shaped configuration extending adjacent the border about the overlying wall panels A and B. Preferably the wall panels are constructed of heavy bulky protective non-woven fabric such as polyester fiber. An open top is defined between the upper edges 11 and 12 of the panels while a tie means D is centrally positioned passing through a tab D as in the openings 13, 14 and through the rear panel A as at 15. The tie then passes through an opening 16 beneath the tab F in the front panel B. The flap E is constructed of relatively stiff material such as composition or plastic material, and a rear portion 17 is sewed thereby as by stitching 18. An upper overlying portion 19 is provided for positioning the front panel 20 of the flap E in overlying position in respect to the tab F. The tab F may also be constructed of similar relatively stiff material. The tie passes beneath the central chain portion 21 of the handcuffs which connects the separate cuff portion 22 and 23.

The tie means D, the flap E and the tab F all form securement means which separate the hands of the wearer and confine the hands and the handcuffs within the mitt. The panels A and B may be constituted by an integral fabric portion forming a pouch.

In use the lock strap is first inserted in front top hole 13, threaded through holes 14, 15 and 16 as illustrated and then the cuff mitt is pulled over hands and handcuffs with flap E away from officer or attendant, making certain that the lock strap is between both hands and under the handcuffs preparatory to fastening.

This restraining device may be used for protecting law officers as when arresting any person who can't be properly searched for weapons. The mitt also helps prevent the prisoner from getting and using a hidden weapon or even the officer's weapon. It also helps protect valuable evidence on the prisoner's hands such as blood, skin scrapings, or powder burns. Furthermore, when transporting prisoner's or mentally ill patients, the cuff mitt serves to prevent them from scratching themselves or the transporting officers. The cuff mitt can also be an invaluable tool in the case of mass arrests when it may be impossible to thoroughly search suspects. Since prisoners hands are rendered useless, there is no way that drugs or evidence can be injested or discarded. Additionally, the cuff mitt prevents prisoners from obtaining any type of device with which they could pick handcuff locks. In fact, the cuff mitt helps prevent the prisoner from picking up virtually any weapon, foreign object, or lock pick.

While a preferred embodiment of the invention has been described using specific terms, such description is for illustrative purposes only, and it is to be understood that changes and variations may be made without departing from the spirit or scope of the following claims.

What is claimed is:

1. A protective mitt for use by police officers or other attendants when placing handcuffs comprised of two cuff elements connected by a connecting element on the wrists having fastening means extending between both hands for further restraining movement of the hands and providing a cover therefor comprising:

a pair of opposed fabric wall panels secured about edge portions leaving an opening for insertion of the hands and wrists with the handcuffs carried thereon;

said fabric wall panels forming a pouch containing the hands, wrists and the handcuffs; and said fastening means carried by said pouch extending between respective cuff elements and around said connecting element securing said handcuffs within said pouch;

whereby the hands are covered and movement thereof is restricted.

2. The structure set forth in claim 1 wherein said fabric wall panels are constructed of bulky non-woven material.

3. The structure set forth in claim 2 wherein said fastening means passes through a stiff flap carried on one of said fabric wall panels and passing over an opposite fabric wall panel.

4. The structure set forth in claim 3 including a tab carried by said opposite fabric wall panel over which said flap is positioned for retention by said tie means.

5. The structure set forth in claim 4 wherein said tie means is a lock strap.

6. A proctective mitt for use by police officers or other attendants when placing handcuffs comprised of two cuff elements connected by a connecting element on the wrists having a tie means extending between both hands for further restraining movement of the hands and providing a cover therefor comprising:

opposed fabric walls secured thereabout leaving an opening for insertion of the hands and wrists with the handcuffs carried thereon;

said fabric walls forming a pouch containing the hands, wrists and the handcuffs; and said tie means carried by said pouch extending between respective cuff elements and around said connecting element securing said cuffs within said pouch;

whereby the hands are covered and movement thereof is restricted.

* * * * *